US006168322B1

(12) United States Patent
Perry et al.

(10) Patent No.: US 6,168,322 B1
(45) Date of Patent: Jan. 2, 2001

(54) APPARATUS FOR PROCESSING EXPOSED PHOTOSENSITIVE ELEMENTS

(75) Inventors: Ronald J. Perry, Webster; David G. Sherburne, Ontario; Franklin C. Brayer, Rochester; Dennis J. O'Dea, Farmington, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/383,569

(22) Filed: Aug. 25, 1999

(51) Int. Cl.[7] ..... G03D 3/08
(52) U.S. Cl. ..... 396/617; 396/621
(58) Field of Search ..... 396/612, 617, 396/620, 621, 622, 602, 603; 134/64 P, 64 R, 122 P; 378/183

(56) References Cited

U.S. PATENT DOCUMENTS

| | | | | |
|---|---|---|---|---|
| 2,733,645 | | 2/1956 | Rose et al. | 396/601 |
| 3,412,667 | * | 11/1968 | Hunt | 134/64 R |
| 4,011,573 | | 3/1977 | Braico | 396/621 |
| 4,125,852 | | 11/1978 | Brooks | 396/622 |
| 4,291,968 | | 9/1981 | Work | 396/601 |
| 4,518,684 | | 5/1995 | Martin | 396/633 |
| 4,853,729 | * | 8/1989 | Tanaka | 396/621 |
| 5,005,036 | * | 4/1991 | Wilsin et al. | 396/621 |
| 5,274,691 | | 12/1993 | Neri | 378/183 |
| 5,870,172 | * | 2/1999 | Blume | 396/569 |

* cited by examiner

*Primary Examiner*—D. Rutledge
(74) *Attorney, Agent, or Firm*—William F. Noval

(57) ABSTRACT

Apparatus for processing exposed photosensitive elements comprising: a cylindrical container having an open end and having a plurality of circumferentially disposed containment vessels for containing processing fluids; an index plate which is rotatably mounted on the container at the open end; a holder for holding an exposed photosensitive element; support structure for mounting the holder on the index plate for movement downwardly and upwardly; and a member on the index plate for manually rotating the plate to sequentially align the holder with the plurality of containment vessels so that at each vessel the holder is manually moved downwardly to submerge the photosensitive element in the processing fluid contained in the vessel and then moved upwardly to remove the element from the fluid.

4 Claims, 3 Drawing Sheets

APPARATUS FOR PROCESSING EXPOSED PHOTOSENSITIVE ELEMENTS

FIELD OF THE INVENTION

This invention relates in general to apparatus for processing photosensitive elements and relates more particularly to apparatus for processing small photosensitive elements such as photographic slides or dental film.

BACKGROUND OF THE INVENTION

Intra-oral dental x-ray films are inserted into a patient's mouth to obtain x-ray images of one or more teeth to determine their health. The opaque dental x-ray film pack can be processed in several ways. One process uses hand processing of the film using a number of trays in a darkroom. This process is messy and inconvenient since it requires handling several processing fluids in a darkroom environment. Several automatic processing machines have also been proposed. U.S. Pat. No. 4,125,852, issued Nov. 14, 1978, inventor Brooks, discloses a dental film carriage for conveying dental film chips through a series of processing stations in an electrically powered dental x-ray film processing machine. U.S. Pat. No. 4,011,573, issued Mar. 8, 1977, inventor Braico, discloses apparatus for developing dental film including a housing, a plurality of receptacles disposed in an arcuate path for processing fluids, and a rotatable film hanger for automatically carrying dental film elements through the sequence of processing steps. The equipment disclosed in these two patents are disadvantageous in needing a source of electrical power, and in their complexity and cost. (See also: U.S. Pat. No. 2,733,645, issued Apr. 18, 1952, inventors Rose et al., and U.S. Pat. No. 4,291,968, issued Sep. 29, 1981, inventor Work, disclose processing devices for strips of film which require either a source of electrical power or a source of water.)

Ways of developing film without a processor or darkroom are also known. Such processes include injecting developing solutions into a film pouch (U.S. Pat. No. 4,518,684, issued May 21, 1985, inventor Martin) or introducing them by breaking a seal between prepackaged film and solution packet U.S. Pat. No. 5,274,691, issued Dec. 28, 1993, inventor Neri). These processes are inherently messy and often produce undesirable conditions for the personnel using them.

There is thus a need for a dental film processing system that is safe, convenient, inexpensive, and easy to use and that does not need sources of electrical power or water hooked up to a processing device.

SUMMARY OF THE INVENTION

According to the present invention there is provided apparatus for processing photosensitive elements, such as dental x-ray film, that solves the problems discussed above.

According to an aspect of the present invention, there is provided apparatus for processing exposed photosensitive elements comprising: a cylindrical container having an open end and having a plurality of circumferentially disposed containment vessels for containing processing fluids; an index plate which is rotatably mounted on the container at the open end; a holder for holding an exposed photosensitive element; support structure for mounting the holder on the index plate for movement downwardly and upwardly; and a member on the index plate for manually rotating the plate to sequentially align the holder with the plurality of containment vessels so that at each vessel the holder is manually moved downwardly to submerge the photosensitive element in the processing fluid contained in the vessel and then moved upwardly to remove the element from the fluid.

ADVANTAGEOUS EFFECT OF THE INVENTION

The present invention has the following advantages.

1. The user is isolated from contact with processing solutions.

2. The developed image can be viewed before processing is completed.

3. The apparatus is simple in construction, low in cost, easy to use, and easy to wash and clean.

4. Chair-side processing in the dental operatory.

5. There is no need for a dark room when film capable of room-light processing is used.

6. There is no need for a source of electricity hooked up to the processing apparatus.

7. There is no need for special plumbing or drains hooked up to the processing apparatus.

DETAILED DESCRIPTION OF THE INVENTION

Figure 1:
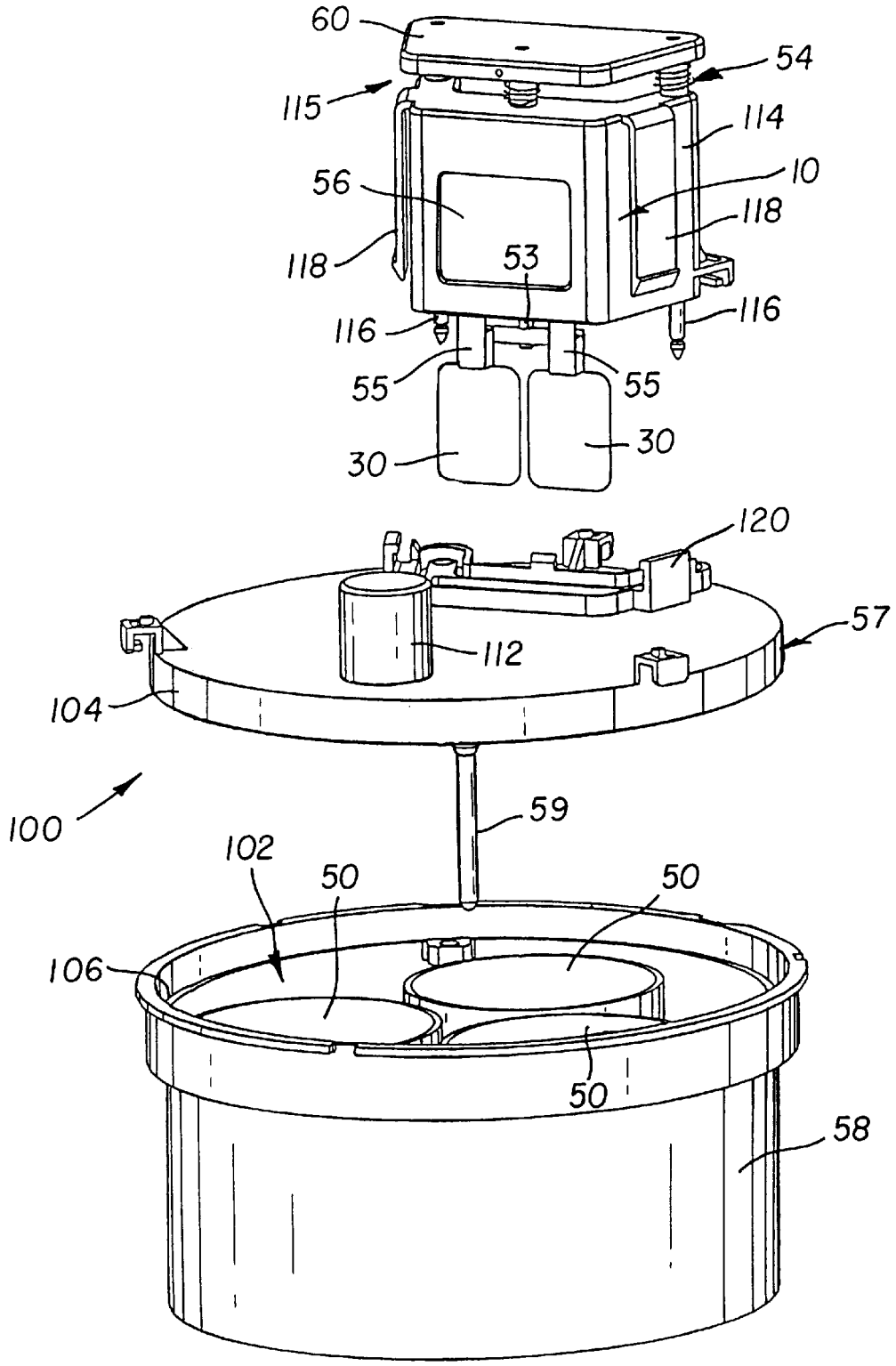
FIG. 1 is an exploded perspective view of processing apparatus according to the present invention.
Figure 2:
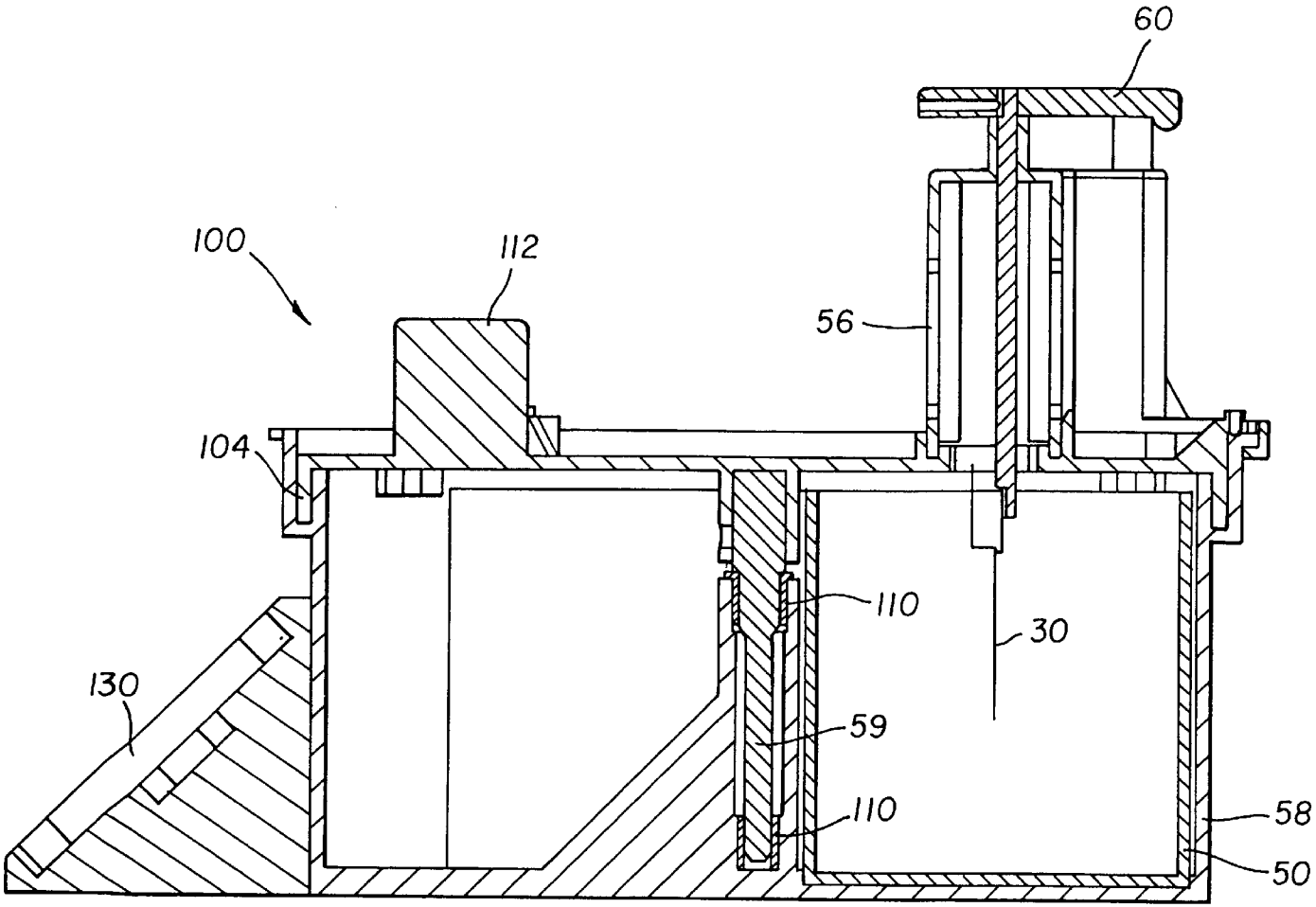
FIGS. 2 and 3 are sectional, elevational views of the apparatus of FIG. 1.
Figure 3:
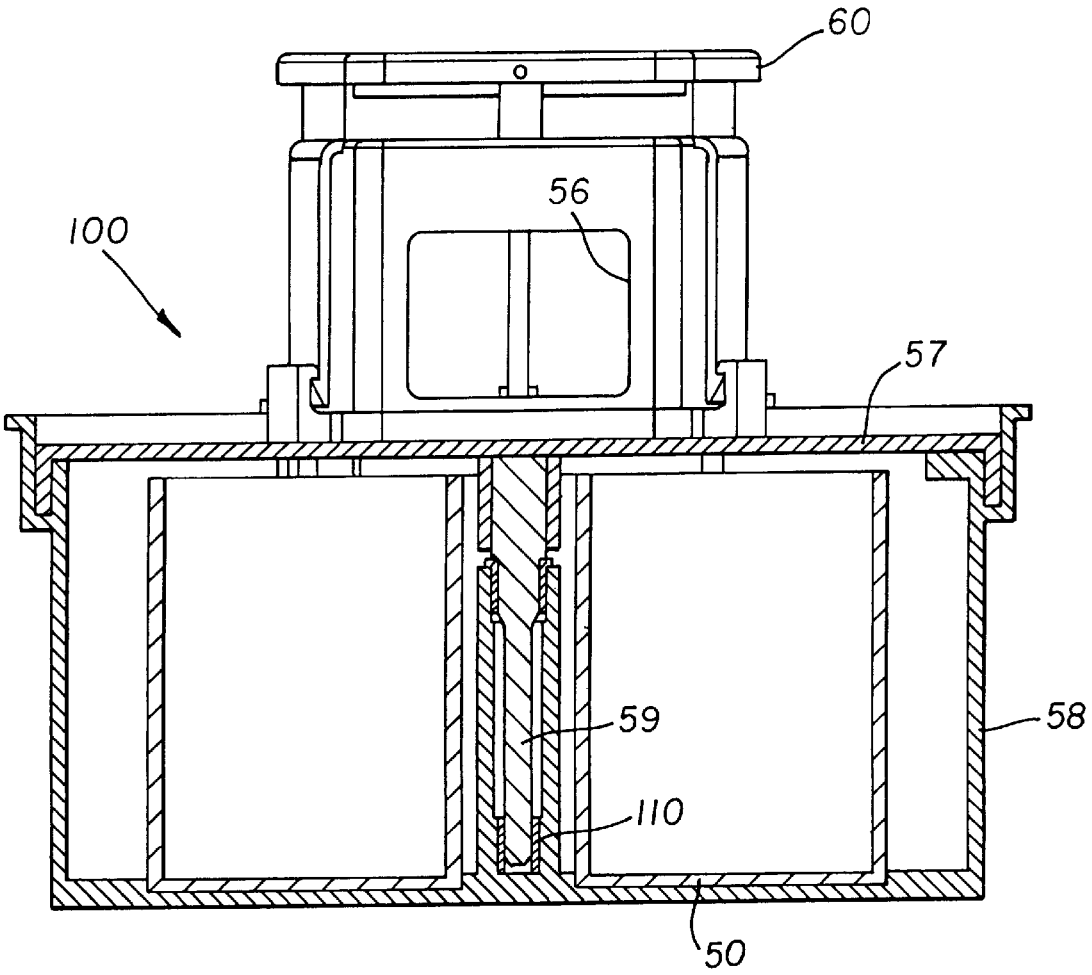

Referring now to FIGS. 1–3, there will be described a preferred embodiment of the present invention. As shown, apparatus 100 includes a cylindrical container 58 having an open end 102 and circumferentially disposed containment vessels 50. Vessels 50 are preferably formed integral with container 58, such as by molding. Vessels 50 contain fluids for processing exposed photosensitive (film) elements 30 immersed therein. Processing fluids for daylight processible dental x-ray film, for example, can include developing, fixing and rinsing fluids. A circular index plate 57 has a downwardly extending rim 104 which fits into annular slot 106 on the end 102 of container 58. A shaft 59 of plate 57 is rotatably mounted by bearings 110 in container 58. A knob 112 facilitates manual rotation of plate 57 when it is mounted on container 58.

A film holder 10 includes a housing 114 having a viewing window 56 for viewing developed film elements 30. Slidably mounted in housing 114 is a film element support assembly 115 including film clips 55 for holding film elements 30, a shaft 53 mounting clips 55, and a handle 60 connected to shaft 53. Guide rods 116 are attached to handle 60 and are slidably mounted in housing 114. Clips 118 engage latches 120 when film holder 10 is mounted on structure 122 of plate 57.

After film elements 30 have been exposed, they are secured to the film holder 10 by means of film clips 55. When handle 60 is moved upwardly, the clips 55 and film elements 30 are moved inside of housing 114. Film holder 10 is mounted on index plate 57 which is then mounted on container 58. By manually rotating plate 57 by means of knob 112, film holder 10 is sequentially aligned with containment vessels 50. At each vessel 50, film element support assembly 115 is manipulated downwardly and then upwardly to submerge the film elements 30 into the processing fluid in the vessel 50, i.e., first into developing fluid, next into fixing fluid, and finally into rinsing fluid. A timer 130 is mounted on container 58 to time the period of submersion in each processing fluid. Handle 60 is moved to agitate the film elements in the processing fluids. After development, the developed film elements 30 can be viewed in window 56.

Film holder 10 is removed from index plate 57 after processing is completed. The film elements 30 are dried and removed from clips 55 for viewing.

The invention has been described in detail with particular reference to preferred embodiments thereof, but it will be understood that variations and modifications can be effected within the spirit and scope of the invention.

Parts list

10 film holder
30 photosensitive (film) element
50 containment vessel
53 shaft
54 springs
55 clip
56 viewing window
57 index plate
58 cylindrical container
59 shaft
60 handle
100 apparatus
102 open end
104 rim
106 annular slot
110 bearings
112 knob
114 housing
115 support assembly
116 guide rods
118 clips
120 latches
122 structure
130 timer

What is claimed is:

1. Apparatus for processing exposed photosensitive elements comprising:

a cylindrical container having an open end and having a plurality of circumferentially disposed containment vessels for containing processing fluids;

an index plate which is rotatably mounted on said container at said open end;

a holder for holding an exposed photosensitive element;

support structure for mounting said holder on said index plate for manual movement downwardly and upwardly relative to said index plate; and a member on said index plate for manually rotating said plate to sequentially align said holder with said plurality of containment vessels so that at each vessel said holder is manually moved downwardly to submerge said photosensitive element in the processing fluid contained in said vessel and then moved upwardly to remove said element from said fluid.

2. The apparatus of claim 1 including a timer mounted on said container for timing the period of submersion of an element in the processing fluid contained in said vessels.

3. The apparatus of claim 1 wherein said holder has a window for viewing a processed element.

4. The apparatus of claim 1 wherein said containment vessels are formed integrally with said container.

* * * * *